United States Patent [19]

Bischof et al.

[11] Patent Number: 4,804,238

[45] Date of Patent: Feb. 14, 1989

[54] TORSION SPRING POWERED DOOR

[75] Inventors: Albert Bischof, Norwood Park Township; Norbert A. Rumps, Jr., Arlington Heights, both of Ill.

[73] Assignee: American Telephone and Telegraph Company - AT&T Teletype, Skokie, Ill.

[21] Appl. No.: 7,846

[22] Filed: Jan. 28, 1987

[51] Int. Cl.[4] ..... A47B 95/00

[52] U.S. Cl. ..... 312/138 R; 312/319; 220/348

[58] Field of Search ..... 312/138 R, 319; 220/345, 346, 347, 348; 49/445; 16/197

[56] References Cited

U.S. PATENT DOCUMENTS

| | | | |
|---|---|---|---|
| 1,597,878 | 8/1926 | Goldsmith | 49/445 |
| 2,038,035 | 4/1936 | Friedrich | 312/319 |
| 2,313,428 | 3/1943 | Glenn | 220/348 |
| 2,477,069 | 7/1949 | Larson | 16/197 |
| 2,531,737 | 11/1950 | Lyon, Jr. | 220/348 |
| 2,600,345 | 6/1952 | Venditti | 312/319 |
| 2,884,157 | 4/1959 | Lampkin | 220/348 |
| 3,913,784 | 10/1975 | Ayres | 220/348 |
| 3,938,690 | 2/1976 | Butler | 220/348 |
| 4,192,422 | 3/1980 | Kotyuk | 220/346 |

*Primary Examiner*—Victor N. Sakran
*Attorney, Agent, or Firm*—A. A. Tirva

[57] ABSTRACT

An access door has a frame formed with longitudinally extending channels which receive a closure element for sliding therealong. A torsion spring secured to the frame and to the closure element maintains the closure element in an open or closed position.

7 Claims, 3 Drawing Sheets

TORSION SPRING POWERED DOOR

TECHNICAL FIELD

This invention relates to access doors located on enclosures and, more particularly, to an access door powered by a torsion spring and used on cabinets or the like.

The door assembly of the type described herein is particularly suited for closing an access opening in a cabinet storing electrical components or controls which may have to be inspected, operated and replaced from time to time. The door is easily installed and is easily movable from its closed to its fully or partially open positions to provide an easy access to the interior of the cabinet.

BACKGROUND OF THE INVENTION

Access doors used in similar cabinets before the present invention are expensive in that they require mechanical latches or stops to keep them in closed or open positions and additionally, the doors are usually hung on hinges, which, when exposed to elements, tend to become rusty and inoperative, or open in such a way as to be a hinderance by interfering with adjacent objects.

DISCLOSURE OF THE INVENTION

In accordance with the present invention, the access door is closed or opened without the use of any mechanical latches or keepers. The door, in a form of a slidable closure element, does not require any hinges as it slides within a frame. A wire torsion spring, such as a music wire or the like, when twisted in one direction, keeps the closure element away from the access opening, and when twisted in another direction, closes the opening by positioning the element over the opening.

Generally, the door assembly of the present invention includes a frame formed with a pair of spaced columns which define opposed longitudinally extending channels. The channels receive the edges of a closure element, or slide. A wire torsion spring, or the like, is connected to the closure element and to the frame so that when the closure element is moved in the channels by exerting a force against it by hand, the spring, through its twisting motion, operates against the closure holding the same in a desired closed, open or partially open position.

THE DRAWINGS

DETAILED DESCRIPTION

Figure 1:
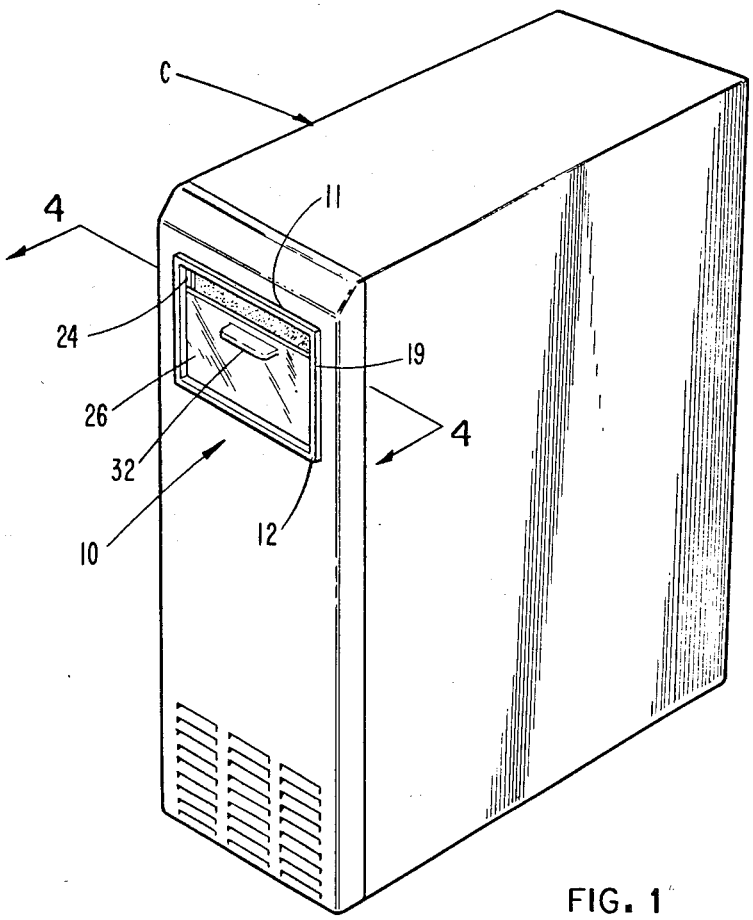
FIG. 1 is a perspective view of a cabinet embodying the present invention.
Figure 6:
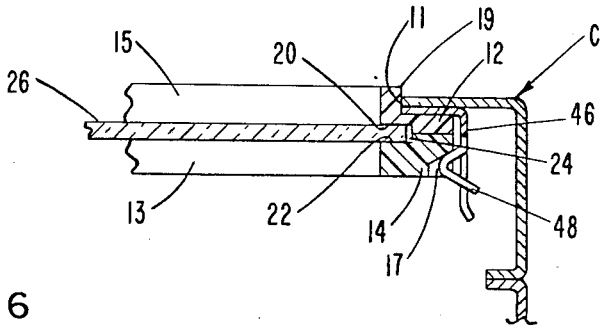
FIG. 6 is a sectional view taken generally along the line 6—6 of FIG. 4.

Referring now to FIG. 1, there is shown a cabinet, generally designated C, formed with an access door assembly, generally designated 10, comprising the present invention.

Figure 2:
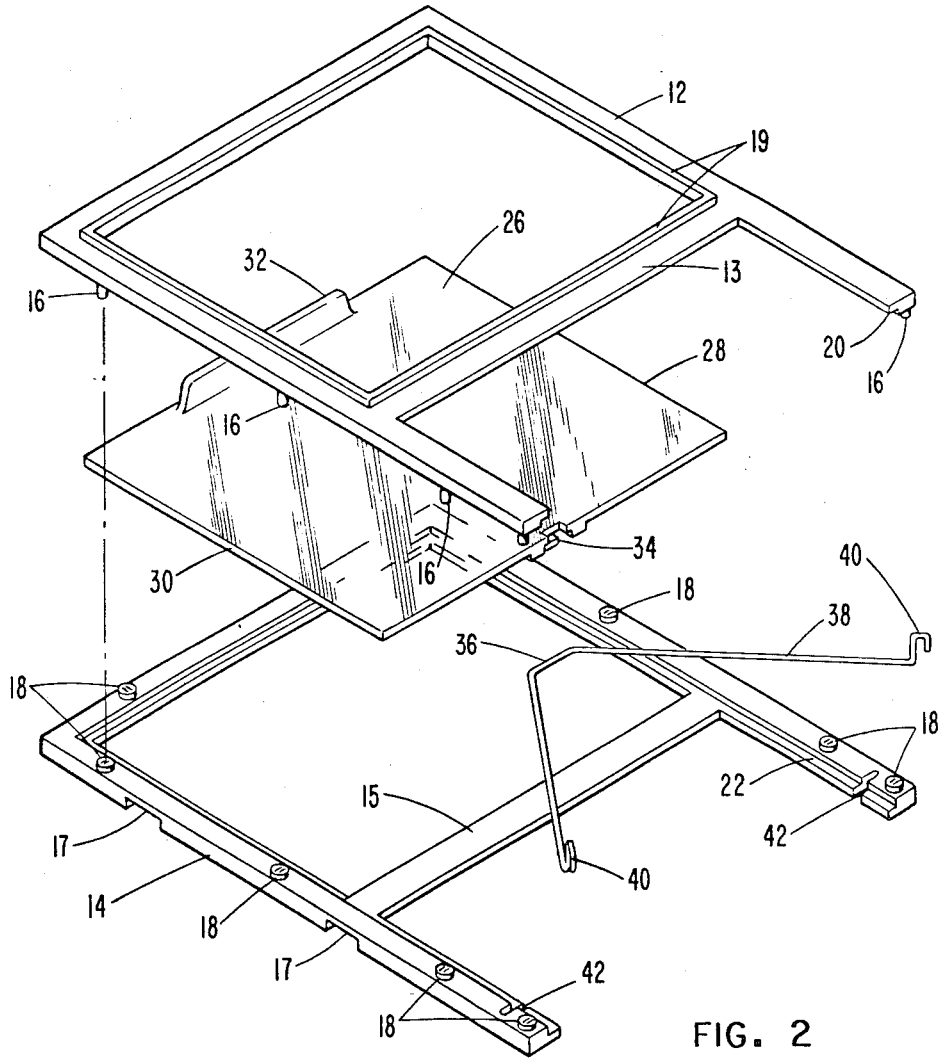
FIG. 2 is an exploded view of the elements comprising the door assembly of the present invention.

The major elements of this invention are best seen in FIG. 2 and include a pair of frame portions 12 and 14 formed with cross-bars 13 and 15, respectively. The frame portion 12 has a plurality of pins 16 extending therefrom, while the frame portion 14 has a plurality of apertures 18 formed thereon for releasably receiving the pins 16 so as to secure the two frame portions to one another without separate fasteners. The frame portion 14 has recesses 17 along its outer edge to facilitate mounting the door assembly 10 on the cabinet C.

Figure 4:
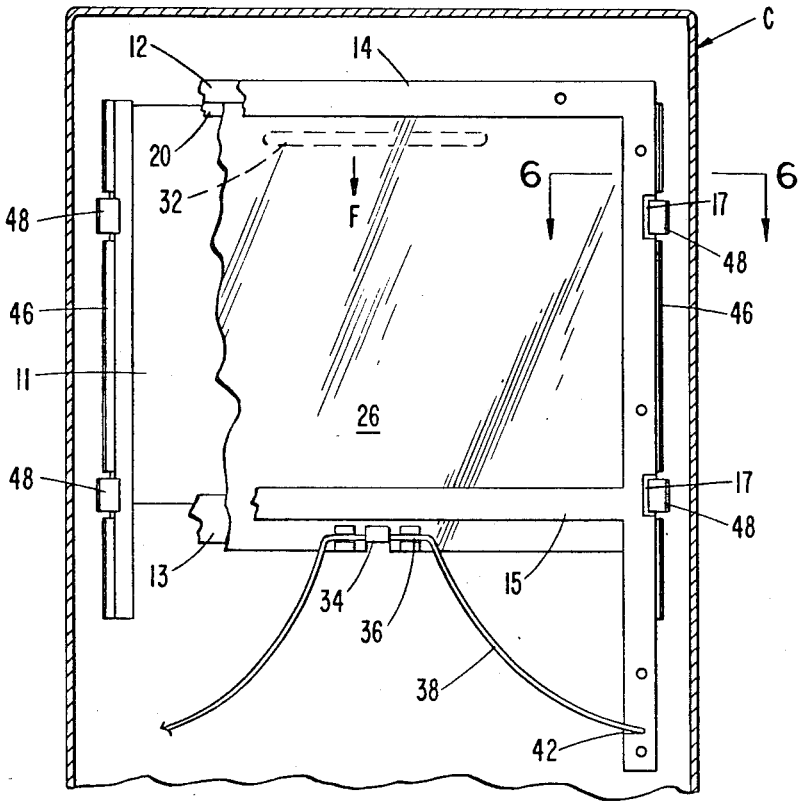
FIG. 4 is a partial sectional view from the interior of the cabinet taken generally along the line 4—4 of FIG. 1 showing the closure element in the closed position.
Figure 5:
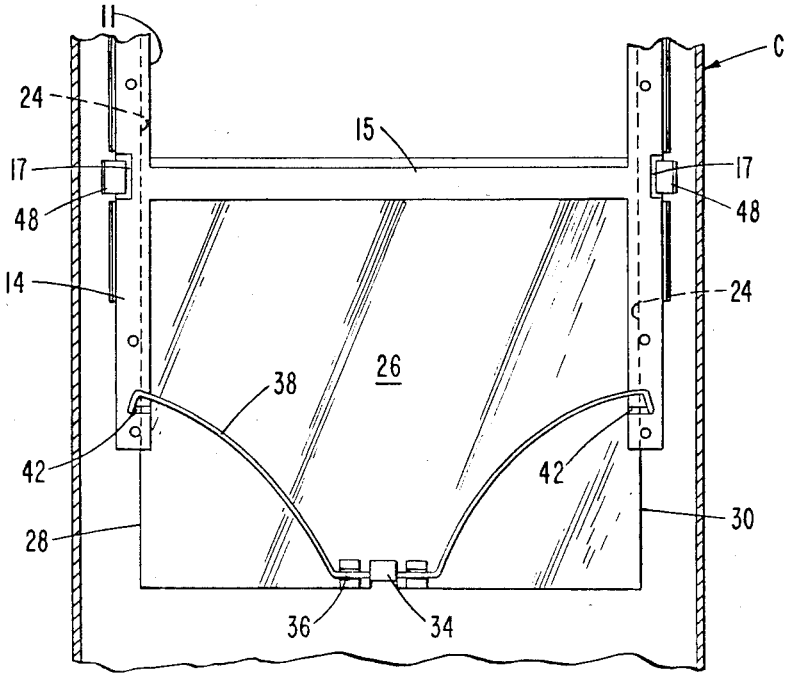
FIG. 5 is a partial sectional view from the interior of the cabinet taken generally along the line 4—4 of FIG. 1 showing the closure element in the open position.

As shown in FIGS. 1, 4 and 5, the front panel of cabinet C has an opening 11 to provide access to the interior of the cabinet. The frame portion 12 has a lip 19 extending from the surface opposite the surface having pins 16, the lip 19 having dimensions allowing it to pass through opening 11 with the minimum amount of clearance. A pair of retainers 46 are fastened on opposite sides of the opening 11 to the back side of the front panel. The retainers 46 are spaced apart so as to allow the frame to pass between them and each has flexible fingers 48 extending from it's sides towards the opening 11. The fingers 48 are adapted to releasably mate with recesses 17 of the frame portion 14.

To mount the access door assembly in the cabinet C, the lip 19 of the frame portion 12 is inserted through the opening 11 of the cabinet C from the back of the front panel whereby frame portion 12 cams the flexible fingers 48 until the lip 19 is securely seated in the opening 11 at which time fingers 48 are able to snap back and enter recesses 17 thereby applying pressure to the frame portion 14 pressing frame portion 12 against the back of the cabinet front panel and thus keeping the lip portion 19 within the opening 11.

The frame portions 12 and 14 have longitudinally extending channels forming grooves 20 and 22, respectively, which, when the two frame portions 12 and 14 are secured to each other, form longitudinally extending channels 24.

A slide, or closure element 26 may be manufactured from transparent material, such as plastic or glass, to permit inspection of contents of the cabinet C without opening of the closure element 26. The width of the closure element 26 allows its edges 28 and 30 to be received in channels 24 for slidable mounting of the element in the door assembly 10 for movement along said channels. The closure element 26 has to be of sufficient height to be able to close off opening 11 of the cabinet C.

One end of the closure element 26 has a hand bar 32 formed thereon for exerting a force and moving the element 26 along the channels 24 into closed or open positions. The opposite end of the closure element has a retainer 34 wherein is mounted a central portion 36 of a wire torsion spring 38.

Figure 3:
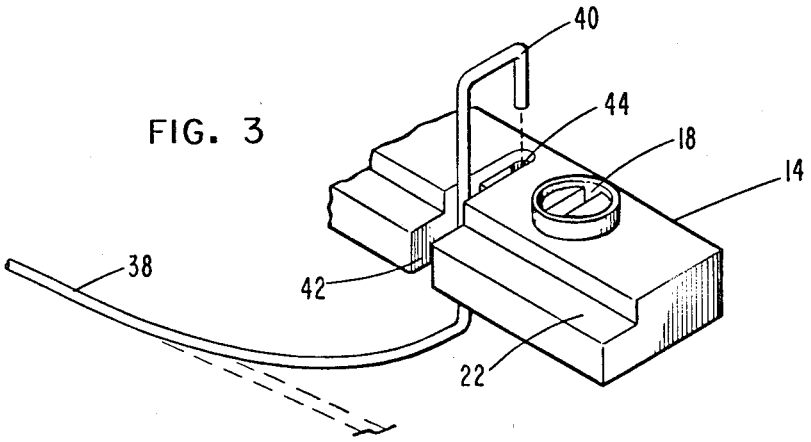
FIG. 3 is a detailed view of the connection between the spring and the frame.

The spring 38 has its opposite ends 40, which are formed in a substantially U-shaped configuration, inserted in slots 42 formed in the frame portion 14 and removably retained in wire tip receiving recesses 44 also formed in frame portion 14, as best shown in FIG. 3.

FIG. 4 shows the element 26 in the closed position, preventing access into the interior of cabinet C via opening 11, the element 26 being held in place by the torsion spring 38. To provide access into the cabinet C, the element 26 is moved by hand pressure exerted on the bar 32 in the direction shown by arrow F, whereby the spring 38 is twisted in the direction of movement with its central portion 36 moving past the imaginary line (not shown) extending between the slots 42 located on both sides of the frame portion 14. The element 26 may be moved to uncover the opening 11 to its maximum and be locked in the open position by complete inversion of the spring 38, as shown in FIG. 5. The closure element 26 may be stopped at a half-way position providing a partial opening to the interior of cabinet C when the spring portion 36 is moved into an alignment with its end portions 40 so that the force exerted by spring 38 forcing the element 26 into the fully closed position is equal to that forcing it into the fully open position, thus, retaining the element 26 in a partially open position.

What is claimed is:

1. An access door assembly for mounting in a cabinet, the cabinet having a substantially rectangular opening, said assembly comprising:

a frame having a pair of spaced columns defining opposed longitudinally extending channels;

a pair of parallel cross-bars connecting said channels, said channels and cross-bars defining an opening which substantially matches shape and size of the opening in the cabinet;

a closure element of a size and shape to fit said opening in the frame having two of its edges slidably mounted in said channels for movement of the closure element therein between open and closed positions;

said columns extending past said opening formed by said columns and said cross-bars so as to accommodate the closure element when said element is in said open position; and a spring means connecting said element to said frame being operable against said element to keep it in an open or closed position.

2. An access door assembly as defined in claim 1, wherein said spring means comprises a wire-type torsion spring.

3. An access door assembly as defined in claim 1 further comprising means for releasably mounting said frame assembly in the cabinet.

4. An access door assembly as defined in claim 3 wherein said mounting means comprises:

a pair of retainers mounted in the cabinet, each retainer having at least two flexible fingers extending therefrom, and;

each of said columns having at least two recesses, each recess adapted to receive of one said fingers.

5. An access door assembly as defined in claim 4 wherein said mounting means further includes a lip extending from one surface of said door assembly, said lip having size and shape allowing it to pass through said opening in said cabinet thereby locating said door assembly in said cabinet.

6. An access door assembly as defined in claim 1, wherein said frame is formed by a pair of parallel frame portions removably connected to each other.

7. An access door assembly as defined in claim 6, wherein a channel is formed in at least one of said frame portions.

* * * * *